United States Patent [19]

Bayer

[11] 4,146,127

[45] Mar. 27, 1979

[54] DEVICE FOR HOLDING AND DISPLAYING FOOTWEAR

[76] Inventor: Earl F. Bayer, 23 Dahlia, Somerset, N.J. 08873

[21] Appl. No.: 853,334

[22] Filed: Nov. 21, 1977

[51] Int. Cl.[2] ..... B65D 25/10; B65D 61/00; B65D 85/42

[52] U.S. Cl. ..... 206/45.14; 206/485

[58] Field of Search ..... 206/45.14, 45.19, 278, 206/280, 292, 294, 297, 299, 476, 485, 562, 564; 229/34 HW; 248/152

[56] References Cited

U.S. PATENT DOCUMENTS 3,658,175 4/1972 Vrana ..... 206/45.14

FOREIGN PATENT DOCUMENTS 2235841 1/1975 France ..... 206/485
303037 10/1965 Netherlands ..... 206/485
393630 6/1933 United Kingdom ..... 206/485

*Primary Examiner*—Davis T. Moorhead
*Attorney, Agent, or Firm*—Harness, Dickey & Pierce

[57] ABSTRACT

A device for holding and displaying footwear and the like, comprising a one-piece monolythic member fabricated of a generally foldable material, the member including a generally planar central section and first and second footwear retaining end sections defining recessed areas adapted for the reception of portions of the footwear disposed on the device and having portions thereof cut away so as to provide access for the insertion of the footwear portions into the recessed areas.

4 Claims, 6 Drawing Figures

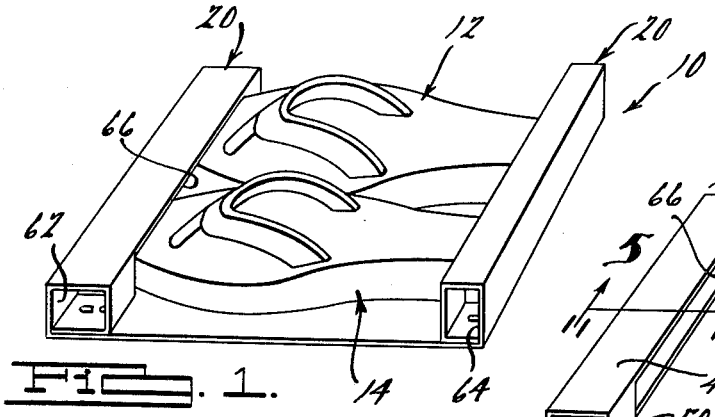
FIG. 1.
FIG. 4.
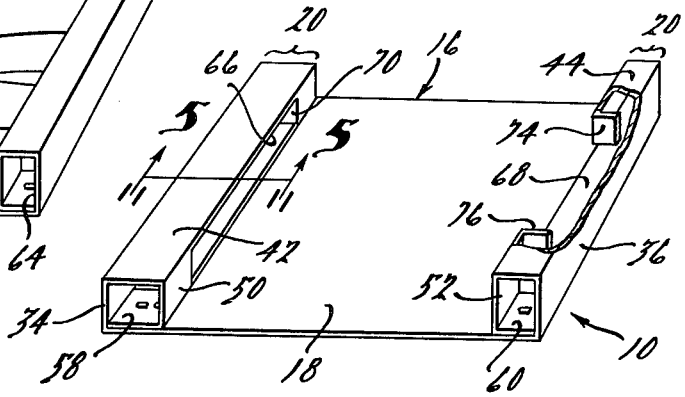
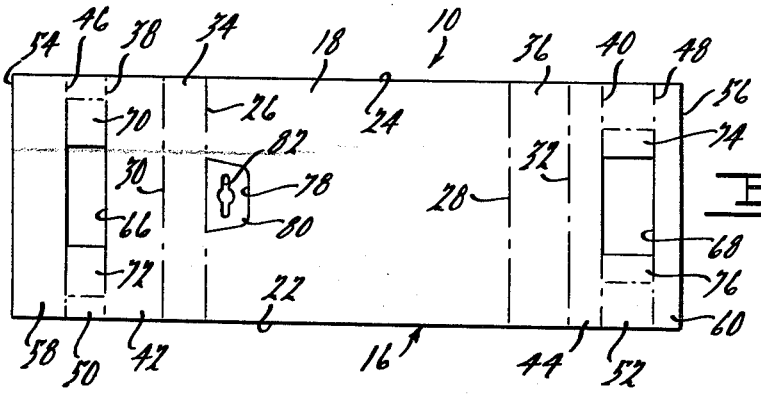
FIG. 2.
FIG. 3.
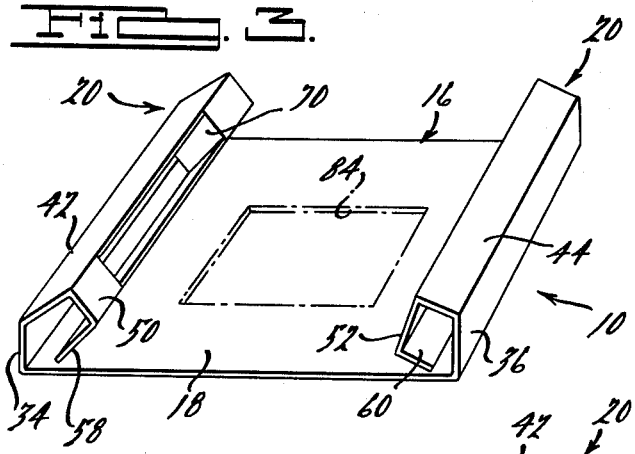
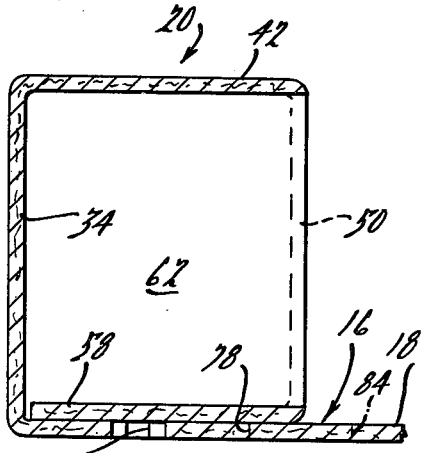
FIG. 6.
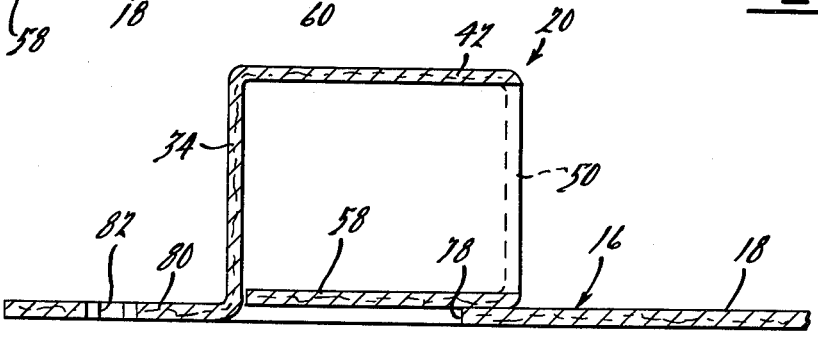
FIG. 5.

DEVICE FOR HOLDING AND DISPLAYING FOOTWEAR

SUMMARY OF THE INVENTION

This invention relates generally to devices for packaging and marketing footwear and, more particularly, to a new and improved device for holding and displaying footwear.

It is accordingly a general object of the present invention to provide a new and improved device for holding and displaying footwear in a manner such that a pair of shoes, sandals, boots, etc., may be operatively secured in a unitized package and be substantially exposed so as to provide for convenient viewing for purposes of inspection, etc., by prospective purchasers thereof.

It is a more particular object of the present invention to provide a new and improved device for holding and displaying footwear which is fabricated of a one-piece foldable member which has end portions thereof folded in a manner so as to define opposed recessed areas into which portions of the footwear disposed on the member may be inserted.

It is another object of the present invention to provide a new and improved device for holding and displaying footwear, as above described, that will find universality of application with various types and styles of footwear and with various sizes and shapes thereof.

It is yet another object of the present invention to provide a new and improved device of the above character which may be manufactured of an extremely economical material, such as fiberboard or cardboard.

It is still another object of the present invention to provide a new and improved footwear holding and displaying device which may be fabricated with an integral attachment means by which the device and the footwear contained therein may be displayed, for example, on a display rack or the like.

It is still a further object of the present invention to provide a device of the above character which may have portions thereof removed so that a prospective purchaser may inspect the design and construction of the sole and heel portions of the footwear contained therein.

Other objects and advantages of the present invention will become apparent from the following detailed description, taken in conjunction with the accompanying drawings.

BRIEF DESCRIPTION OF THE DRAWINGS

FIG. 1 is an elevated perspective view of the footwear holding and displaying device of the present invention, as shown in operative association with an exemplary pair of footwear;

FIG. 2 is a plan view of the device shown in FIG. 1, as it appears preparatory to folding and asembly thereof;

FIG. 3 is an elevated perspective view of the device shown in FIG. 2 as it appears in a partially folded configuration;

FIG. 4 is a fragmentary elevated perspective view of the device shown in FIG. 3, as it appears after being completely assembled;

FIG. 5 is an enlarged fragmentary cross-sectional view taken substantially along the line 5—5 of FIG. 4; and FIG. 6 is an enlarged fragmentary cross-sectional view, similar to FIG. 5, of an alternate form of the present invention.

DETAILED DESCRIPTION OF THE PREFERRED EMBODIMENTS

Referring now in detail to the drawings, and in particular, to FIGS. 1–3, a device for holding and displaying footwear and the like is generally designated by the numeral 10 and is shown in typical operative association with a pair of footwear, such as sandal-like shoes 12 and 14. It is to be noted that the present invention is in no way intended to be limited in use with the illustrated type of footwear, and that the footwear 12, 14 are depicted herein merely by way of example. The device 10 generally comprises a rectangular-shaped member 16 fabricated of a foldable material, such as fiberboard, cardboard or the like. The member 16 includes a generally rectangular-shaped central section 18 and a pair of opposed end sections, generally designated by the numeral 20. Generally speaking, the shoes 12, 14 or the like are adapted to be supported upon the member 16 by having the opposite ends thereof nestingly received within the end sections 20, whereby the shoes 12, 14 are substantially exposed, for purposes of inspection and the like.

As best seen in FIG. 2, the central section 18 of the member 16 is defined by a pair of spaced parallel side edges 22, 24, and by a pair of spaced parallel fold lines 26, 28 which extend at right angles to the side edges 22, 24. The fold lines 26, 28 cooperate with a pair of additional fold lines 30, 32 arranged parallel thereto to define side portions 34, 36 of the end sections 20. The fold lines 30, 32 in turn cooperate with another pair of fold lines 38, 40 arranged parallel thereto to define a pair of top portions 42, 44 of the end sections 20. The fold lines 38, 40 in turn cooperate with spaced parallel fold lines 46, 48 to define another pair of side portions 50, 52 of the end sections 20, and fold lines 46, 48 cooperate with end edges 54, 56 of the member 16 to define attachment portions 58, 60 which function in a manner hereinafter to be described.

As best seen in FIG. 3, fabrication of the device 10 is achieved by folding the side portions 34, 36 along the fold lines 30, 32 such that the portions 34, 36 are arranged at right angles or perpendicular to the central section 18. The top portions 42, 44 are then folded along fold lines 38, 40 to a position perpendicular to the side portions 34, 36, i.e., parallel to the central section 18. The side portions 50, 52 are folded along fold lines 46, 48 to a position perpendicular to the central section 18 and top portions 42, 44, i.e., parallel to the side portions 34, 36. Finally, the attachment portions 58, 60 are folded along fold lines 46, 48 to a position parallel to the central section 18, i.e., perpendicular to the side portions 50, 52, whereupon the attachment portions 58, 60 may be fixedly secured by any suitable adhesive means, staples or the like to the central section 18 which results in the portions 34, 42 and 50 and 36, 44 and 52 defining a pair of generally rectangular cross-sectional-shaped recessed areas 62, 64, respectively, at the opposite ends of the central section 18.

As shown in FIG. 2, the member 16 is formed with a pair of generally rectangular-shaped openings 66, 68 (located in the side portions 50, 52, respectively) which, upon fabrication of the device 10 in the manner hereinabove described, provide access to the interior of the recessed areas 62, 64. The size of the openings 66, 68 are intended to be consistent with the size and shape of the particular footwear with which the device 10 is to be associated and will, of course, vary with the size and style shoes disposed at the ends of the openings 66, 68 is a pair of tabs 70, 72 and 74, 76, respectively, which are adapted to be folded to positions position generally transversely of the interior of the associated recessed areas 62, 64 for strengthening and reinforcing the same. The use of such tabs 70–76 is optional, depending upon the type of material from which the device 10 is fabricated and the cross sectional size and shape of the areas 62, 64 within which the ends of the shoes 12, 14 are disposed therewith.

If desired, the central section 18 (or some other portion of the member (16) may be formed with a generally U-shaped slit 78 defining a foldable tab 80 having an opening 82 which may be utilized in operatively supporting the device 10 and associated footwear, for example, upon a suitable display rack or the like, as will be appreciated by those skilled in the art.

At such time as the device 10 has been assembled in the manner above described, the shoes 12, 14 may be operatively aligned with the openings 66, 68, with the forward ends of the shoes 12, 14 being inserted, for example, into the opening 66 a sufficient distance to permit the opposite or rearward ends of the shoes 12, 14 to be pivoted to a position adjacent the central section 18, whereupon the shoes 12, 14 may be moved slightly away from the end section 20 having the opening 66 toward the end section 20 having the opening 68 therein such that rearward ends of the shoes 12, 14 are inserted into the opening 68, resulting in the shoes 12, 14 being positively retained upon the device 10. With this arrangement, the shoes 12, 14 are supported in a manner such that substantially full exposure thereof is achieved, thus, a prospective purchaser of the footwear can fully inspect the color, style, quality of manufacturer, etc., without requiring removal of the footwear from the device 10. It is contemplated that the central section 18 may be formed with one or more cut-away openings, such as is indicated at 84 in FIGS. 3 and 6 so that when the shoes 12, 14 are disposed on the device 10, inspection may also be had of the sole construction of the shoes via such opening 84. This is particularly desirable when footwear, such as athletic shoes and the like are associated with the device 10 wherein considerable importance is placed upon the sole construction of such footwear.

A particular feature of the present invention resides in the fact that the device 10 may be fabricated in an extremely economical manner so as to not add excessively to the basic expense of the footwear being marketed. Of course, another important feature of the present invention resides in the fact that footwear disposed within the device 10 may be readily displayed via well-known display racks and the like so that the purchasing public need not go through the exercise of having to open successive "shoeboxes" to inspect for color, quality, style, etc., as has been the practice in the past in connection with marketing footwear. Another feature of the present invention resides in the fact that the device 10 will find universality of application with virtually all types of footwear and the size and shape of the end sections 20 may be appropriately correlated with virtually all known types of footwear, thus minimizing to the extreme the need for manufacturing and handling traditional footwear-type boxes. FIG. 6, for example, depicts an alternate shape of the end section 20 shown in FIG. 5, wherein the height and/or depth of the recessed area 62 may be varied in accordance with the associated shoe size and style.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A device for holding and displaying footwear and the like comprising, a one-piece monolythic member fabricated of a generally foldable material, said member comprising a generally planar central section and first and second footwear retaining end sections, said end sections of said member defining recessed areas adapted for the reception of portions of the footwear disposed on the device and having portions thereof cut-away so as to provide access for the insertion of said footwear portions into said recessed areas, each of said end sections comprising first and second side portions arranged perpendicular to said central section, a third portion interconnecting said first and second portions and arranged parallel to said central section, and a fourth portion arranged generally parallel to said central section and fixedly secured thereto, said first, second, third and fourth portions of said end sections being integrally connected to one another and to said central section, and one of said portions of each of said end sections having a part thereof cut-away so as to provide access for insertion of said footwear portions into said recessed areas, the cut-away part of each of said end sections providing integral tab elements arranged generally perpendicular to said central section and each of said portions for rigidity and preventing collapsing of said end sections.

2. The invention as set forth in claim 1 wherein said device is fabricated of a fiberboard-like material.

3. The invention as set forth in claim 1 wherein said device is fabricated of cardboard.

4. The invention as set forth in claim 1 wherein said central section has a portion thereof defining attachment means by which said device may be removably secured to a display rack or the like.

* * * * *